United States Patent [19]

Hunnicutt, Jr.

[11] Patent Number: 4,853,981

[45] Date of Patent: Aug. 8, 1989

[54] VENTILATED WATER CLOSET

[76] Inventor: Clyde J. Hunnicutt, Jr., 3026 E. Garfield St., Phoenix, Ariz. 85008

[21] Appl. No.: 123,609

[22] Filed: Nov. 20, 1987

Related U.S. Application Data

[63] Continuation of Ser. No. 840,436, Mar. 14, 1986, abandoned, which is a continuation-in-part of Ser. No. 693,365, Jan. 22, 1985, abandoned, which is a continuation-in-part of Ser. No. 584,268, Feb. 27, 1984, abandoned.

[51] Int. Cl.[4] ..... E03D 9/04

[52] U.S. Cl. ..... 4/213; 4/217

[58] Field of Search ..... 4/213, 217

[56] References Cited

U.S. PATENT DOCUMENTS

| | | | |
|---|---|---|---|
| 2,301,738 | 11/1942 | Miller | 4/213 |
| 2,320,065 | 5/1943 | Briscoe et al. | 4/213 |
| 3,003,157 | 10/1961 | Belcher | 4/217 |
| 3,689,944 | 9/1972 | Clayton | 4/213 |
| 4,168,553 | 9/1979 | Studer | 4/213 |
| 4,344,194 | 8/1982 | Pearson | 4/213 |

*Primary Examiner*—Henry J. Recla
*Assistant Examiner*—Linda J. Sholl
*Attorney, Agent, or Firm*—Don J. Flickinger; Jordan M. Meschkow; Lowell W. Gresham

[57] ABSTRACT

An improved toilet bowl air deodorizing system comprises a toilet seat hingedly coupled to the toilet bowl permitting the toilet seat to assume horizontal and vertical stable positions and a substantially hollow toilet seat lid hingedly coupled to the toilet bowl likewise permitting the lid to assume stable horizontal and vertical positions. The hollow lid houses both deodorizing means and exhaust means which includes a disposable filter cartridge and a direct drive motor for driving a fan. An intake channel is coupled to a rear portion of the lid and has an opening which is maneuvered into a position proximate the space between the lower surface of the seat and an upper surface of the bowl only when the lid is in its vertical position. Detectors are placed in both the lid and the seat to assure that the exhaust means is energized only when the lid is in its vertical position and a user is sitting on the seat. An improved hinge arrangement is provided.

11 Claims, 8 Drawing Sheets

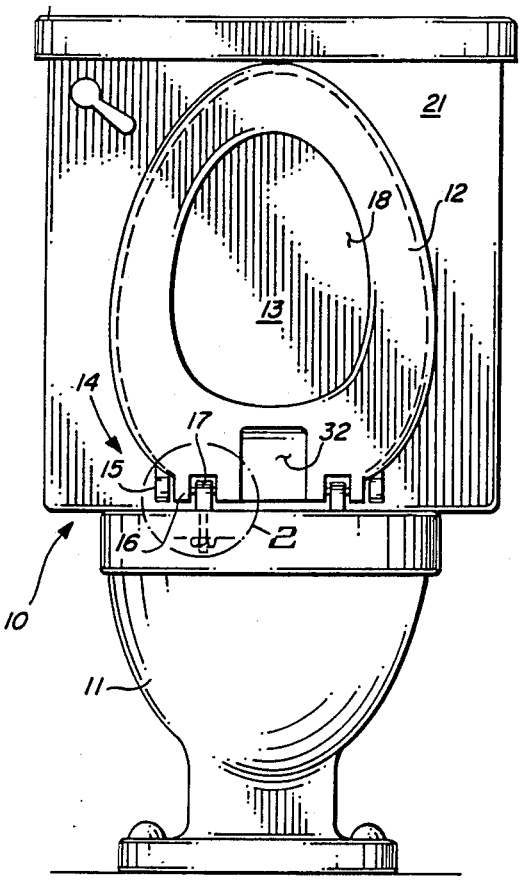
FIG-1
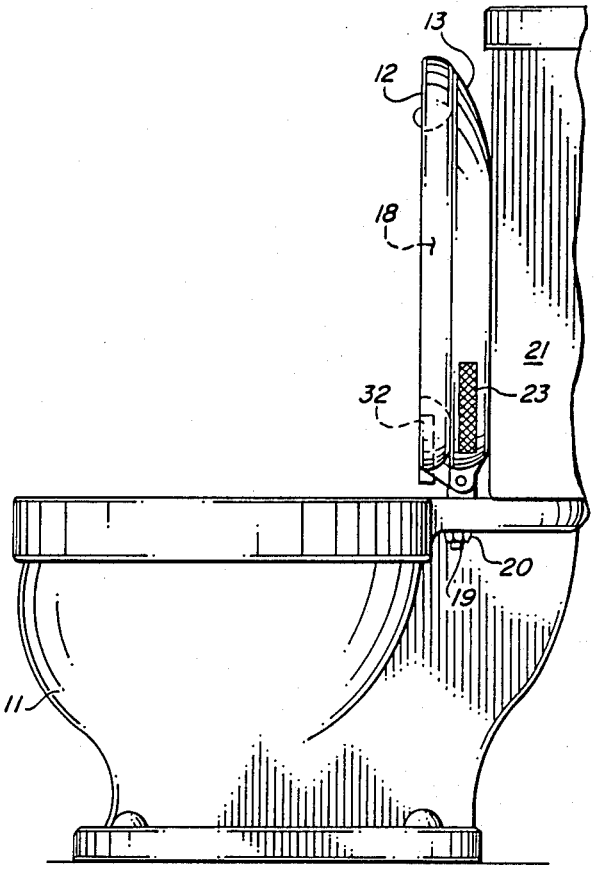
FIG-3
FIG-2
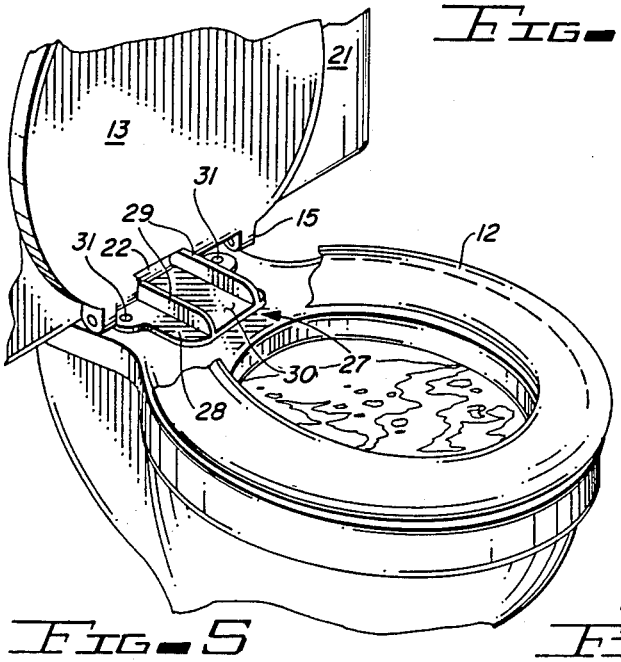
FIG-5
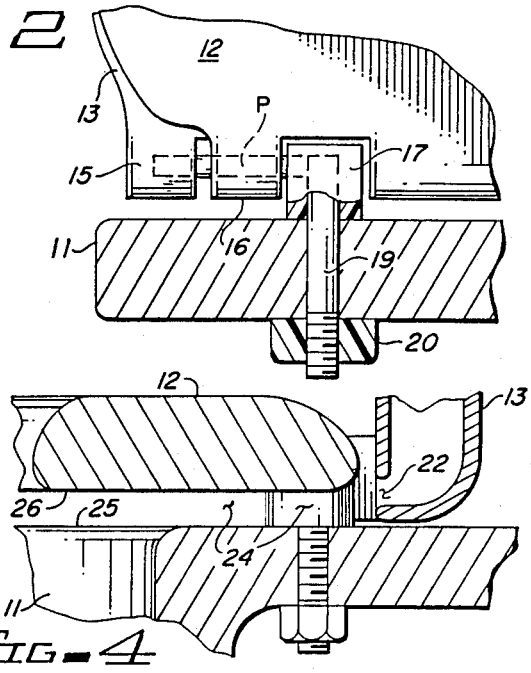
FIG-4

FROM BOWL
TO FAN

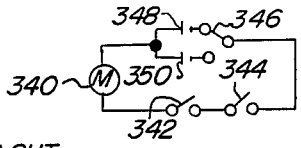
FIG. 30
FIG. 22
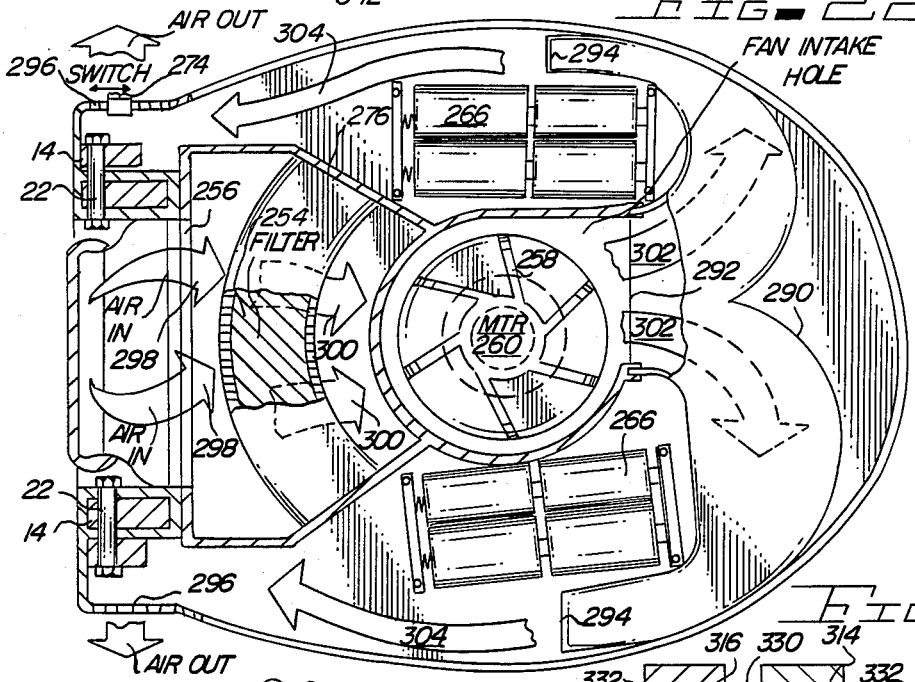
FIG. 25
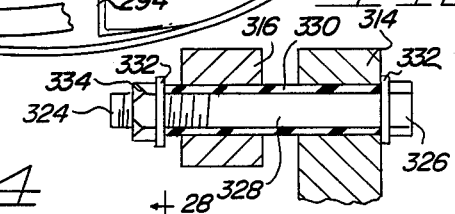
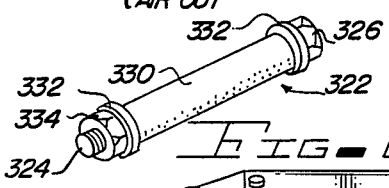
FIG. 24
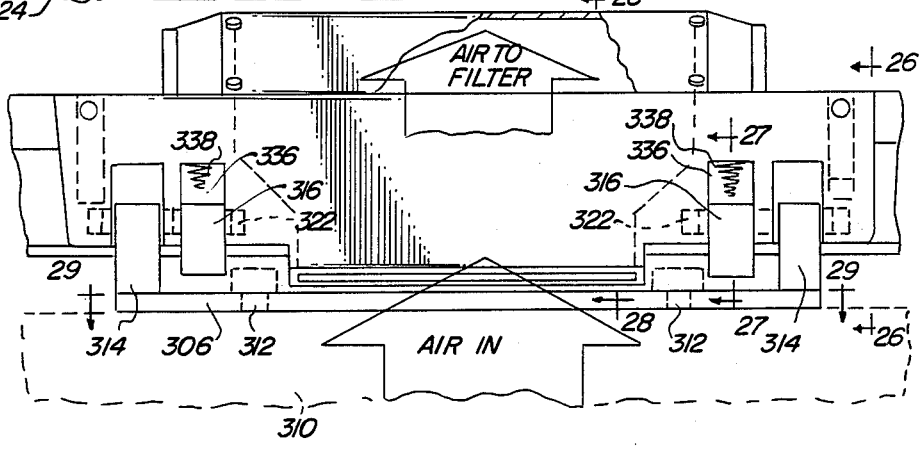
FIG. 23

VENTILATED WATER CLOSET

CROSS REFERENCE TO RELATED APPLICATIONS

This application is a continuation of application Ser. No. 840,436 filed Mar. 14, 1986, now abandoned which is a continuation-in-part of application Ser. No. 693,365 filed Jan. 22, 1985 now abandoned which is continuation-in-part of application Ser. No. 584,268, filed Feb. 27, 1984 now abandoned entitled TOILET LID AIR DEODORIZER IMPROVEMENT.

BACKGROUND OF THE INVENTION

1. Field of the Invention

This invention relates to ventilated water closets and, more particularly, to a system for forceably ventilating water closets.

This invention also relates to improvements in ventilating attachments for water closets wherein the exhaust and deodorizing device are housed in the toilet lid.

2. The Prior Art

The prior art is replete with devices for drawing off and deodorizing the air from a toilet bowl. The primary problem to be solved resides in providing means for efficiently drawing air from the bowl and directing it to a point where it may be treated and deodorized for release to the surrounding environment. Some such devices employ waterways leading into the toilet bowl as means for exhausting the air. In other cases, the toilet seat has a hollowed out interior to provide air passageways therethrough to be used in drawing off air from the toilet bowl. In still other cases, various attachments have been provided for use at a point, or points, about the periphery of the toilet bowl to provide an air exhaust channel for directing air to treatment devices.

After the malodorous air has been drawn from the bowl, it is then necessary to provide treatment devices packaged in a manner which will not detract from the door of the bathroom. No matter how attractively the exhaust and deodorizing devices are housed, they remain a distraction and are often a nuisance if they must be moved in order to clean around and about them. Further, they may be unsightly if connected to the toilet bowl by means of flexible hoses or the like and/or lend an unbalanced perspective to the toilet apparatus.

These problems are partially solved by a design concept which houses the exhaust and deodorizing devices within a hollow lid cover of the toilet seat. While the appearance of such a deodorizing arrangement constitutes a major step in advancing the state of the art, the problem of communicating the malodorous air from the toilet bowl to the deodorizing device remains. The toilet seat lid must be free to be raised and lowered independent of the movement of the toilet seat itself. Proponents of the prior art have derived air conduit means for communicating the malodorous air to the deodorizer device within the hollow lid. To this end, a hollow pintle on which the toilet lid an toilet seat are pivotally mounted for independently swinging movement between their raised and lowered positions has been employed to provide an air passageway between the interior space of the toilet bowl and the deodorizing device within the hollow lid. Such hollow pintles are, however, expensive to fabricate and add significantly to the overall cost of the deodorizing system.

SUMMARY OF THE INVENTION

It is an object of the present invention to provide an improved in-lid deodorizer.

It is a still further object of the present invention to provide an in-lid deodorizer system in which the toilet seat itself may be a standard toilet and seat and one which may be padded without interfering with the operation of the deodorizing system.

Still another object of the present invention is to provide means for communicating air from a toilet to a deodorizing device in a hollow toilet seat lid by selectively coupling the deodorizing device to the air flow from the toilet bowl only when the hollow lid is raised position and the user is sitting on the toilet seat.

A still further object of the present invention is to avoid the use of complicated and expensive devices for communicating air from the toilet bowl to a deodorizing device within the hollow lid of a toilet seat.

A still further object of the present invention is to provide an in-lid deodorizing apparatus which utilizes a direct drive motor for driving an exhaust fan.

According to a broad aspect of the invention there is provided a toilet bowl air deodorizing system, comprising a toilet seat hingedly coupled to a toilet bowl permitting the toilet seat to assume horizontal and vertical stable positions, a space being created between an under surface of the seat and an upper surface of the bowl when the seat is in its horizontal position; and a substantially hollow toilet seat lid hingedly coupled to the toilet bowl permitting the lid to assume horizontal and vertical stable positions, the lid including deodorizing means, exhaust means; and an intake channel coupled to a rear portion of the lid and having an opening which is maneuvered into the space when the lid is in its vertical position. This is made possible, in part, through the use of a special hinge arrangement.

According to a further aspect of the invention there is provided an improved toilet bowl air deodorizing system of the type wherein there is provided a toilet seat hingedly coupled to the toilet bowl and a substantially hollow toilet seat lid hingedly coupled to the toilet bowl and housing deodorizing means therein, the improvement comprising exhaust means coupled within the hollow lid and including a fan and a direct drive motor.

According to a still further aspect of the invention there is provided an improved toilet bowl air deodorizing system of the type wherein there is provided a toilet seat hingedly coupled to a toilet bowl permitting the toilet seat to assume horizontal and vertical stable positions, and a substantially hollow toilet seat lid hingedly coupled to the toilet bowl for housing deodorizing means and exhaust means, wherein the improvement comprises first means for activating the exhaust means only when the lid is in a vertical position and a user is sitting on said seat.

According to a still further aspect of the invention there is provided an air deodorizing system wherein the toilet seat is hingedly coupled to the toilet bowl by at least one electrically conductive hinge post. An electrical contact is provided within said lid proximate the electrically conductive hinge post for contacting the hinge post when the lid is in its vertical position so as to energize the exhaust means.

The above and other objects, features and advantages of the present invention will be more clearly understood from the following detailed description taken in conjunction with the accompanying drawings, in which:

BRIEF DESCRIPTION OF THE DRAWINGS

FIG. 1 is a front elevation view of a toilet bowl fitted with a toilet seat and a hollow lid. The seat and lid are hinged in a conventional manner to the toilet bowl.

FIG. 2 is an elarged detail of the hinging arrangement seen within the broken line of the circle designated 2 in FIG. 1.

FIG. 3 is a side elevation of the toilet of FIG. 1.

FIG. 4 is an elarged sectional detail of a drawing with the seat in its lowered position and the lid in its raised position, showing the void which generally exists between the seat and the upper surface of the toilet and the manner in which the air inlet orifice of the hollow lid is placed in juxtapostion with the void when the lid is in its raised position.

FIG. 5 is a partial perspective, showing the toilet with the hollow lid in the raised position and the addition of a channel plate with raised walls to provide a defined channel within the void between the seat and the upper surface of the toilet bowl. The channel plate is maintained in position by the bolt which affixes the hinges to the toilet bowl.

FIG. 22 is a plan view of the interior of the hollow lid shown in FIG. 21.

FIG. 23 is a rear view of the in-lid deodorizing system shown in FIGS. 21 and 22.

FIGS. 24 and 25 are perspective and cross-sectional views respectively of a hinge pin utilized in the in-lid deodorizing of FIGS. 21 and 22.

FIG. 30 is a schematic drawing illustrating how the in-lid deodorizing system of FIG. 21 is energized.

DETAILED DESCRIPTION OF THE PREFERRED EMBODIMENT

Figure 7:
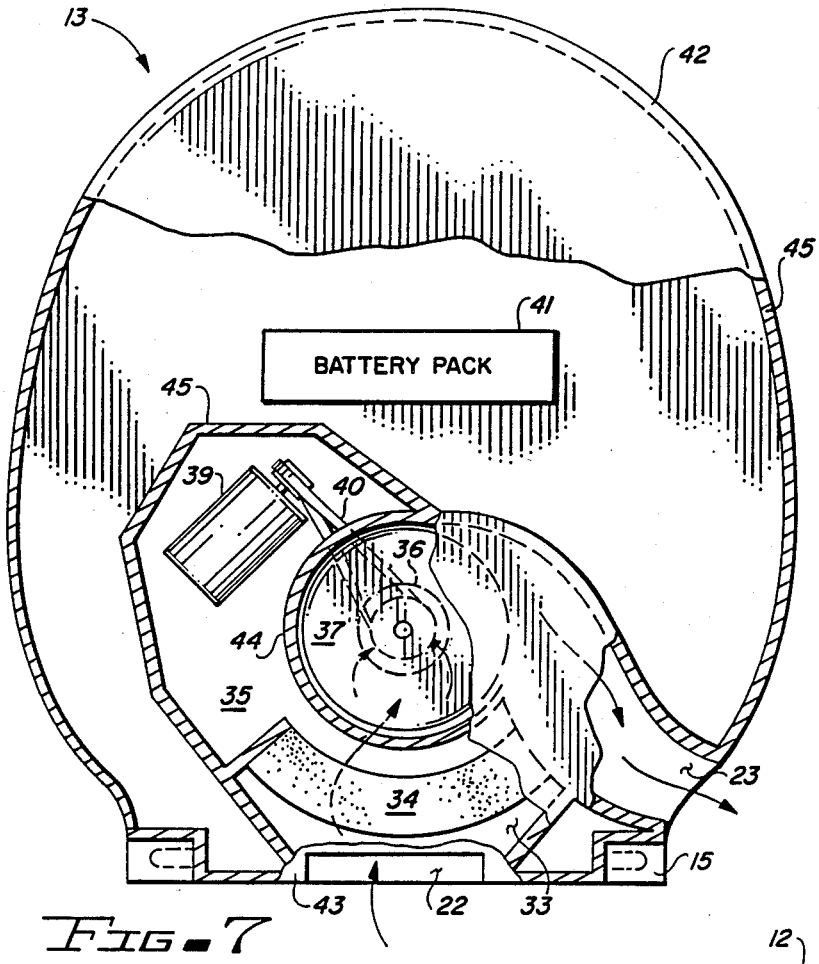
FIG. 7 is a plan view of the interior of the hollow lid, showing the arrangement of the deodorizing and exhaust devices, the battery pack and the wall for providing air plenums within the hollow lid. The face of the lid is removable and is not shown in FIG. 7.

For the purposes of promoting and understanding of the invention, reference will now be made to the embodiments illustrated in the drawings. Specific language will be used to describe the apparatus. It will, nevertheless, be understood that no limitation of the scope of the invention is thereby intended, such alterations and further modifications of the principles of the invention as illustrated herein being contemplated as would normally occur to one skilled in the art to which the invention relates.

The invention represents an improvement in toilet lid air deodorizers. To avoid the cost and complexity of the prior art, no attempt is made to maintain air passageway communication between the toilet bowl and the raised lid except in those instances in which the lid is raised to its generally vertical position with respect to the top surface of the toilet bowl. The raising of the lid will position an air intake orifice of the hollow lid in juxtaposition with the air flow passage beneath the toilet seat so as to communicate air from the toilet bowl to the deodorizing device within the hollow lid.

In FIG. 1 the general reference character 10 refers to the overall invention. A toilet bowl 11, is equipped with a toilet seat 12 and a lid 13, which are affixed to the toilet bowl by means of hinges 14. This hinged arrangement permits the seat and lid to be lowered to a horizontal position with respect to the upper surface of toilet bowl 11 or raised to a generally vertical position with respect to that upper surface, and the movement of the seat and lid may be accomplished independent of each other.

The detail of FIG. 2 illustrates the hinge post 17 which is affixed to toilet bowl 11 by means of bolt 19 and nut 20. A pin passes from hinge post 17 through seat hinge 16 and into lid hinge 15 so that the seat 12 and lid 13 may be independently rotated abouta that pin. The hinge arrangement as depicted is meant to be typical and is not provided as a limitation on the means for practicing the invention.

Seat 12 is provided with a conventional opening 18 and complies with generally accepted standards of toilet seat construction. The seat need not be hollowed out to provide a plurality of air channels therethrough and because of its generally solid nature, it may be padded to provide additional comfort to the user.

In the side elevation of FIG. 3, the lid 13 and seat 12 are shown in their raised positions generally parallel to the face surface of watertank 21 and vertical to the upper surface of toilet bowl 11. Lid 13 is hollow and houses the deodorizing system. Malodorous air from the toilet bowl 11 will be drawn through an air intake orifice into the hollow lid to be deodorized and exhausted through an air-exhaust orifice into the environment. The illustration of FIG. 3 shows the air-exhaust orifice 23. The details of the lid housed air deodorizing system will set forth hereinafter.

In the partial cross-section view of FIG. 4, the seat 12 is in its lowered position and hollow lid 13 is in its raised position. As is generally the case, a void 24 is seen to exist between the upper surface 25 of bowl 11 and the lower surface 26 of seat 12. The area of the void of interest here is that which exists in the region between hinge bolt 19. For purposes of the invention, void 24 will be assumed to exist regardless of how closely the lower surface 26 of the seat is positioned with respect to upper surface 25 of the bowl. In FIG. 4, hollow lid 13 is seen to be provided with an air intake orifice 22. Raising the lid to its generally vertical position places air intake orifice 22 in juxtaposition with void 24 in the region between hinge posts 17. When the exhaust device housed within hollow lid 13 is activated, air will be drawn from bowl 11 through a void 24 into air intake orifice 22 to the interior of lid 13, where the air will be deodorized and exhausted through air-exhaust orifice 23 (FIG. 3).

To more effectively channel the air from bowl 11 through void 24 and air intake orifice 22 to the interior of lid 13, a channel plate 27 may be provided. As illustrated in FIG. 5, channel plate 27 consists of a coupling plate 28 having a pair of raised walls 29, which define a channel 30. Through-holes 31 in plate 28 are coupled to hinge bolts 19 so as to maintain channel plate 27 in position. When so emplaced, channel 30 provides a defined air communication pathway through the void 24 which exists between seat 12 and the upper surface 25 of bowl 11. By so defining a walled channel within void 24, the efficiency of airflow through void 24 is increased.

Figure 6:
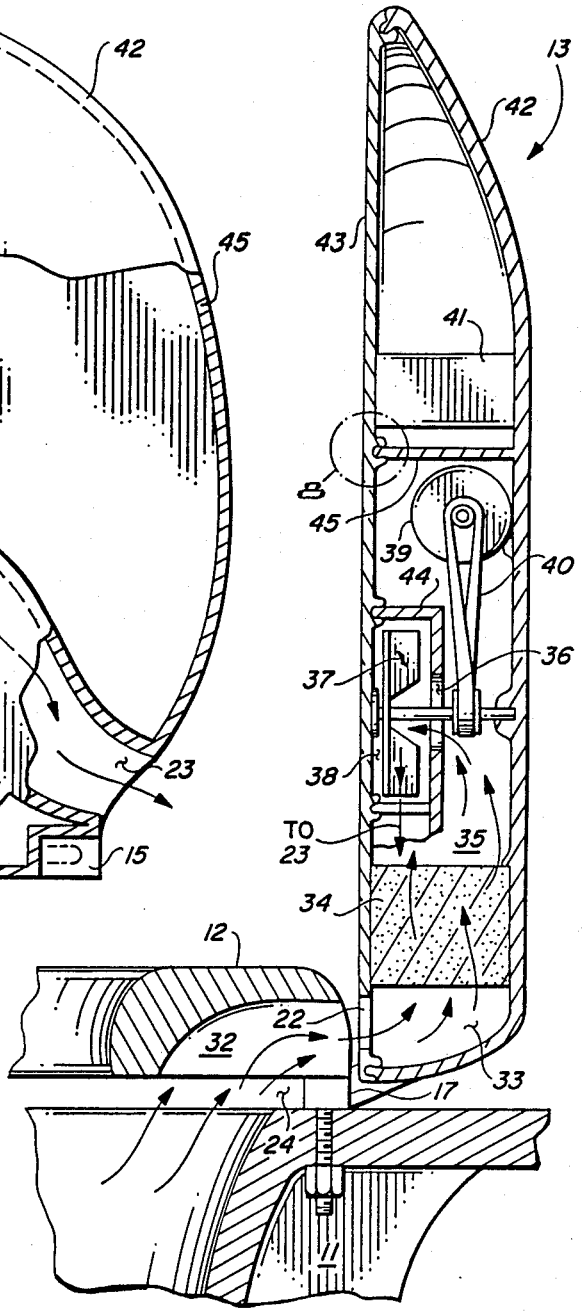
FIG. 6 is a cross-sectional view through the hollow raised lid of the invention, showing the exhaust and deodorizing devices therein. The toilet seat has been provided with an undercut channel to improve the airflow from the toilet bowl to the interior of the hollow lid. This undercut channel is also indicated in FIGS. 1 a and 3.

A presently preferred alternate embodiment for increasing the efficiency of the airflow through void 24 is illustrated in cross-section in FIG. 6. Here, an undercut channel 32 is emplaced within the lower surface of seat 12. Channel 32 is not visible when seat 12 is in its lowered position. Channel 32 is further illustrated in the elevation of FIG. 1 and shown in phantom outline in the elevation of FIG. 3. With lid 13 raised, as illustrated in FIG. 6, the air intake orifice is placed in immediate juxtaposition with undercut channel 32 so as to efficiently draw off and channel air from bowl 32 into the hollow interior of lid 13.

It should be noted that the method of drawing air from the bowl through void 24, either directly or by channeling the airflow through that void, results in increased efficiency in performing the deodorizing function of the system. The air so drawn from bowl 11 is drawn from the immediate vicinity of the anus of the person utilizing the toilet. Experimentation has shown that the pressure differential required for the exhaust system will be minimal when the air from bowl 11 is channeled from the immediate vicinity of the user's anus. Drawing air off from the positions about the bowl only increases the required rate of exhaust airflow necessary to achieve the deodorizing function.

Returning to FIG. 6, hollow lid 13 is seen to be comprised of a relatively rigid outer wall 42, which provides a dished structure. A removable face 43 completes the lid 13. An attachment margin 43 (FIG. 7) is provided for maintaining the coupling of removable face 43 to the rigid outer wall of lid 13. Any suitable means may be utilized for this purpose, for example, hook-and-loop fasteners, temporary adhesive margins, magnetic coupling, and the like.

Figure 8:
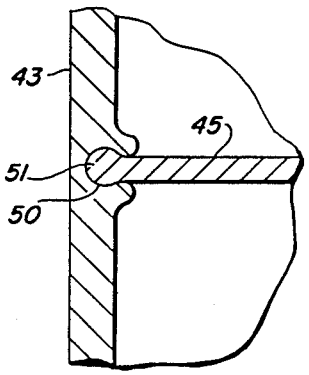
FIG. 8 is a detail taken from the area within the broken line circle designated 8 in FIG. 6 to show the manner in which the removable face of the hollow lid is coupled to the walls defining the various air plenums within the hollow lid.

Interior walls within the hollow lid 13 require an airtight coupling to the removable face 43 so as to define selected air plenums within the hollow lid. FIG. 8 illustrates the manner in which such an air-tight coupling of face 43 may be achieved with a plenum wall, for example wall 45. In the areas in which wall 45 is to be coupled to face 43, a round-bottomed ribbed channel 50 is provided with a rounded edge 51, which when pressed into the round-bottomed ribbed channel 50, will be locked in place and provide a relatively air-tight seal along the length of channel 50.

The mechanics of the lid housed air deodorizing system will best be understood by review of FIGS. 6 and 7 in light of the following discussion. The rotation of impeller 37, will create a lowered air pressure within hollow lid 13. In response to this lowered air pressure, air will be drawn from toilet bowl 11 through undercut channel 32 and air intake orifice 22 into a first air plenum 33. The air is drawn through a filter 34, wherein it is deodorized. Filter 34 may contain any appropriate deodorizing agent, for example, activated charcoal. The deodorized air is then drawn into a second air plenum 35 and drawn through impeller exhaust orifice 36 to impeller chamber 38 as a result of the rotary action of impeller 37. From impeller chamber 38, the air is directed toward air exhaust orifice 23 where it is exhausted to the immediate environment. Impeller 37 is driven by motor 39, which is coupled to the shaft of impeller 37 by means of a belt drive 40. While it is conceivable to provide a direct motor drive to impeller 37, the restricted confines of the interior of hollow lid 13 would require a special and therefore expensive motor and would almost invariably result in a reduction in the height of the vanes of impeller 37, thereby reducing its efficiency. Thus, while not limiting the invention to use with an indirect, belt drive impeller, the embodiment presented is presently preferred for the economic and manufacturing advantages it offers. It should be noted that the walls 44 defining impeller chamber 38 are actually supported by attachment to wall 42 of lid 13. These attachment points have not been shown in FIG. 6 for the sake of clarity in explaining the operation of the invention.

Motor 39 is energized by a power pack 41. Power pack 41 may comprise batteries and, if so, it is preferable if the batteries are rechargeable.

Figure 9:
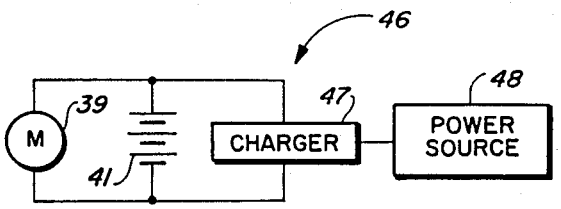
FIG. 9 is a schematic drawing showing the manner in which the exhaust drive motor is energized.

Schematic 46 of FIG. 9, indicates the motor 39 which drives impeller 37 and the manner in which the motor is energized. Motor 39 is selected to be a low-voltage DC motor which is powered by power pack 41. Power pack 41, as noted, may be a pack of rechargeable batteries. It is preferred that the rechargeable battery pack 41 have a discharge capacity below the limits at which the potential for electrical shock exists. In the present preferred embodiment battery pack 41 is rechargeable and has an output potential on the order of 12 volts. Battery pack 41 is coupled to battery charger 47 as to maintain the charged level on battery pack 41. Charger 47 draws its energy from power source 48. Power source 48 may represent energy available from utility company service lines. Alternatively, a power source 48 may represent energy provided by a light-activated device such as an array of photo-sensitive diodes. Such an array of photo-sensitive diodes may be maintained in the vicinity of the invention and draw in the ambient light to maintain battery pack 41 in a charged condition. Such an array of light-activated semiconductors may be located within the bathroom in close proximity to the invention, may be mounted near a window or lighting fixture and wired to battery pack 41 to maintain the charge on that battery. Those skilled in the art will recognize that a low-voltage motor may be driven directly from the energy generated by such an array of lightactivated semiconductors. Such an array of semiconductors may even be worked in to the frame of a mirror or picture and placed within the bathroom and, since the bathroom is frequently lighted when the toilet is not in use, the light energy accumulated by the semiconductor array, will maintain the charge on battery pack 41. Commercially available, flat wiring which is nearly invisible when adhesively fastened to a wall surface may be effectively employed in coupling battery pack 41 to its charging device and power source.

Figure 10:
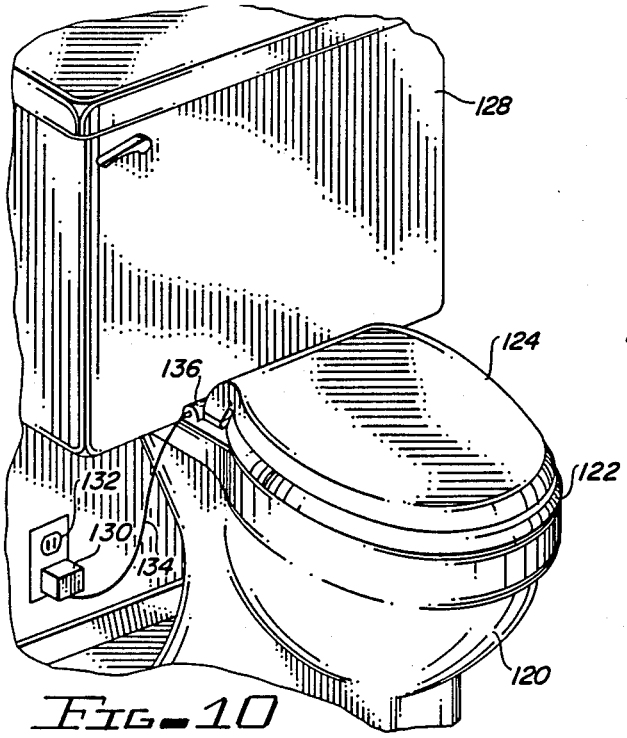
FIG. 10 is a perspective view of a toilet utilizing an alternate inventive in-lid deodorizing system.
Figure 17:
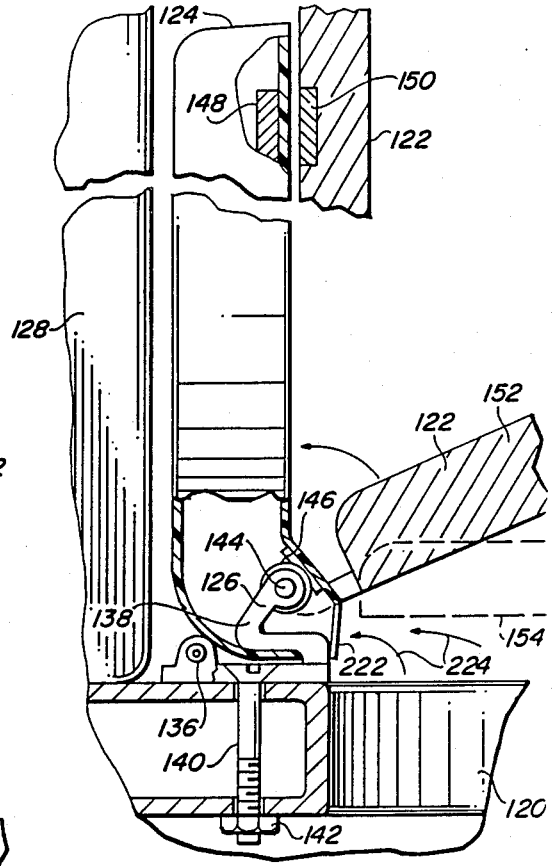
FIG. 17 is a side cross-sectional view illstrating the toilet seat in each of its stable positions.
Figure 19:
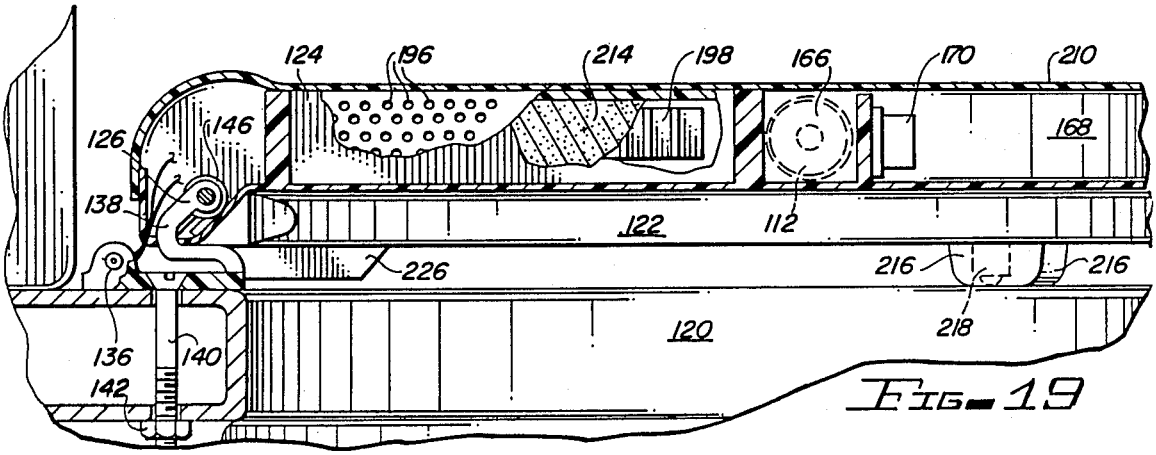
FIG. 19 is a side cross-sectional view illustrating in cutaway fashion the hinge arrangement upon which the toilet seat and lid are mounted and also the internal workings of the lid of the inventive deodorizing system.

Referring to FIG. 10, a toilet bowl 120 is equipped with a toilet seat 122 and a lid 124, which are hingedly coupled to toilet bowl 120 by means of hinge 126 (see FIGS. 17 and 19). This hinge arrangement permits the seat and lid to be lowered to a horizontal position with respect to the upper surface of toilet bowl 120 or raised to a generally vertical position with respect to that upper surface, and the movement of the seat and lid may be accomplished independent of each other. Toilet 120 is provided with a tank 128 for supplying water to toilet bowl 120 as is well known in the art. An AC-DC adapter 130 is shown coupled to a standard AC wall outlet 132 and, by means of wire 134, to an electrical inlet 136 so as to apply electrical energy to the inventive lid deodorizing apparatus as will be described more fully hereinbelow.

Referring briefly to FIG. 17, a C-shaped hinge post 138 is affixed to toilet bowl 120 by means of bolt 140 and nut 142. While only such bolt and nut assembly is shown it should be appreciated that in actuality two such assemblies will be utilized to secure the lid and seat to the toilet. A pin 144 passes through hinge post 138 and through corresponding openings in the rear portions of seat 122 and lid 124 so as to allow seat 122 and 124 to be independently rotated about pin 144. A coil spring 146 is provided around pin 144 and has ends which bear against an interior wall of lid 124. The spring is biased so as to prevent lid 122 from slamming onto the upper surface of bolt 120. Furthermore, both lid 124 and seat 122 are provided with magnets 148 and 150, respectively, which attract each other so as to prevent seat 122 from accidentally falling. Thus, when both seat 122 and lid 124 are in their upright positions, seat 122 must be manually separated from lid 124 by the user and, even if allowed to fall at that point, its downward motion will begin to be resisted by spring 146 at some intermediate position indicated at 152. Seat 122 will then slowly come to rest in its horizontal position which is indicated by dotted outline 154.

Figures 11, 13, 14, 20:
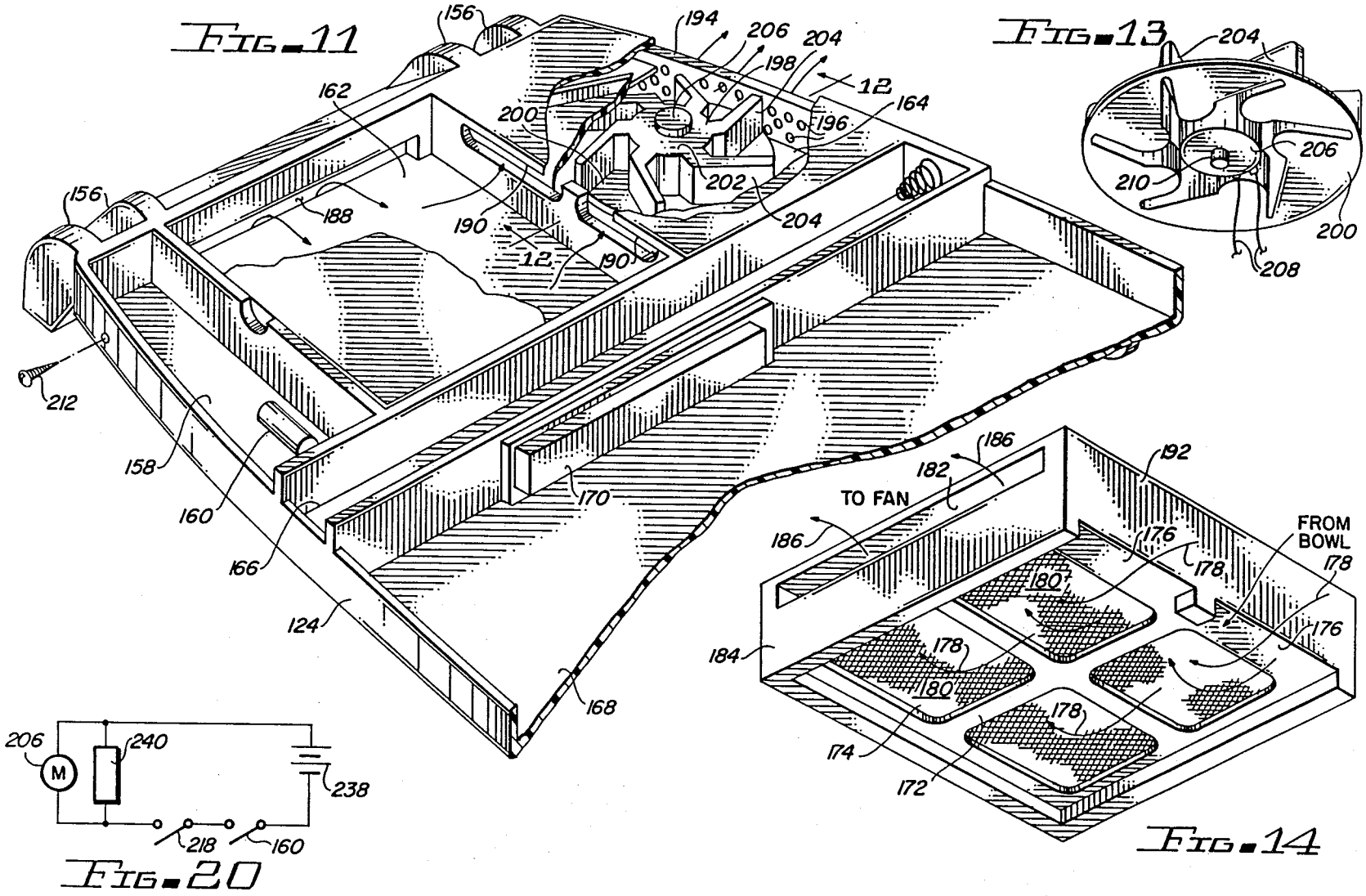
FIG. 11 is a perspective cut-away view of a portion of the inner workings of the lid shown in FIG. 10.
FIG. 13 is a bottom perspective view of the fan and direct drive motor employed in the lid of FIG. 11.
FIG. 14 is a perspective view of the under portion of a filter used in the lid of FIG. 11.
FIG. 20 is a simple functional schematic diagram illustrating how the inventive deodorizing system is electrically energized.

Referring now to FIG. 11, lid 124 is shown with its cover removed. As can be seen, the lid includes rear extending portions 156 which receive pin 144 (FIG. 17) thus permitting lid 124 to be rotated thereabout. The interior of the lid also includes a tilt switch compartment 158 which includes tilt switch 160 which closes only when the lid is in its vertical position, a filter compartment 162 for housing a filter of the type shown if FIG. 14, a motor and fan compartment 164, a battery compartment 166 which may be used to energize the deodorizing apparatus as an alternative to adapter 130 shown in FIG. 10, and an additional compartment 168 including an electronics package 170 which serves to connect the electrical apparatus in the manner shown and described in conjunction with FIG. 20.

Referring briefly to FIG. 14, the filter shown includes an underportion 172 including windows or openings 174 and recessed portions 176. As a result of the vacuum created by the motor and fan assembly as will be described below, malodorous air from the toilet is drawn through windows 174 as is indicated by arrows 178 and through an enclosed filter medium 180 (e.g., activated charcoal). Filtered air then exits opening 182 in sidewall 184 of the filter in the direction indicated by arrows 186.

Referring again to FIG. 11, it can be seen that the filter compartment includes an opening 199 through which malodorous air is drawn from the interior of the toilet bowl in a manner to be described below and openings 190 through which filtered air is drawn into the fan and motor compartment 164. Thus, disposable filter (FIG. 14) is placed in filter compartment 162 such that recessed portions 176 in sidewall 192 of the filter housing register with opening 188 in the filter compartment, and opening 182 in sidewall 184 of the filter housing registers with openings 190 in the filter compartment leading into the fan and motor compartment 164. Sidewall 194 of lid 124 has a plurality of apertures 196 therethrough adjacent the fan and motor assembly to permit filtered air to escape into the surrounding environment.

Fan 198 (also shown in FIG. 13) includes a base plate 200 and a hollow hub portion 202 extending upward therefrom. A plurality of radial vanes 204 extend radially outward from hub 202 and are fixed along one edge thereof to base plate 200. The body of a direct drive motor 206 which receives electrical energy, via conductors 208 from either batteries contained in battery compartment 166 or from AC adapter 130 as previously described, is centrally positioned within an opening in hub 202 of fan 198. This permits the rotary motion of motor shaft 210 to be directly coupled to the end wall of hub 202 of fan 198 to produce rotation thereof. The lid's cover 210 (FIG. 19) may be simply placed over the compartmentized lower portion of the lid and secured by means of screws 212. This provides for easy replacement of filters, batteries and servicing, if necessary, of the fan and motor assembly.

FIG. 19 is a cross-sectional view of the lid and seat assembly in their horizontal positions. As can be seen, FIG. 19 illustrates the various chambers and components described in connection with FIG. 11 including batteries 112 and filter 214. It should also be noted that seat 122 is provided with standard bumpers 216 which bear against the upper surface of toilet 120. However, in accordance with the teachings of the present invention, a microswitch or similar device 218 is provided in one of the bumpers 216. This switch closes only when a user is sitting on seat 122. Thus, through the action of switch 218 and tilt switch 160, the motor and fan assembly are only energized when lid 124 is in its vertical position and a user is sitting on seat 122.

Figure 18:
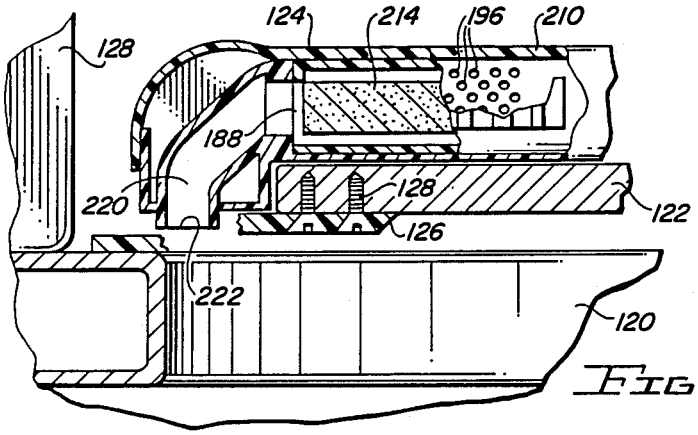
FIG. 18 is a side elevational view illustrating the air intake portion of the alternate inventive deodorizing system when both the seat and lid are in a horizontal position.

Referring now to FIG. 18, it can be seen that the rear portion of lid 124 includes a channel 220 which has an opening 222 residing in a plane which is substantially parallel to the general plane of the lid. That is, channel 220 bends approximately 90 degrees such that the plane of opening 222 is substantially perpendicular to the plane of opening 188 leading into filter compartment 162.

Figure 15:
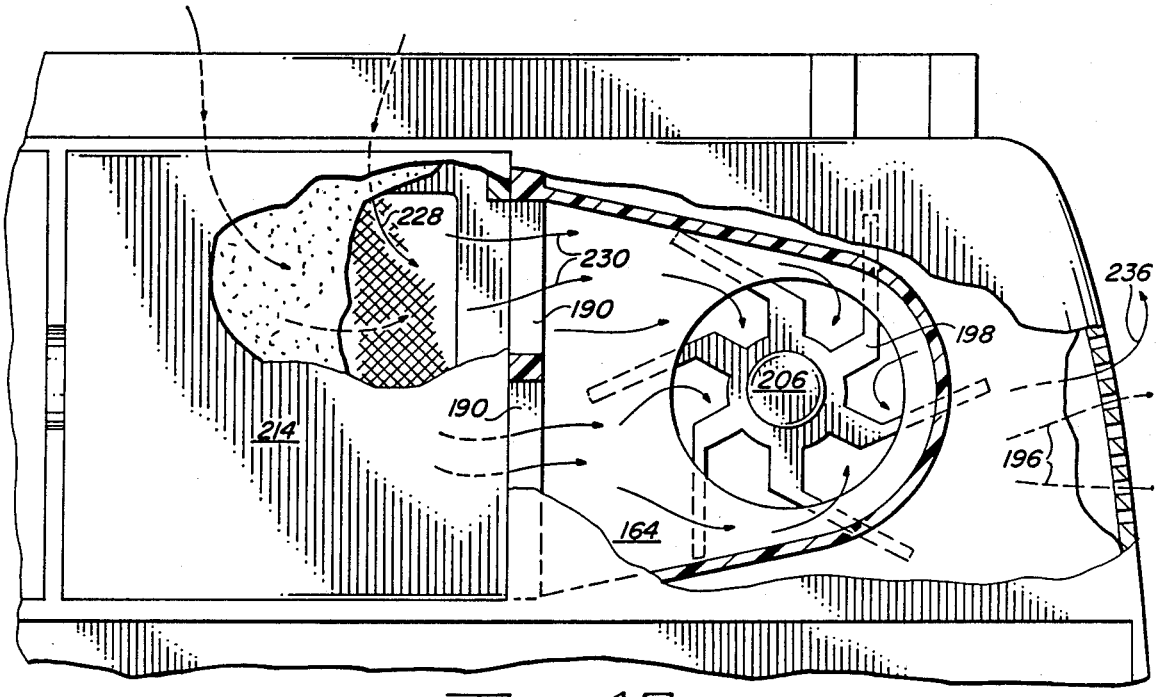
FIG. 15 is a partial cut-away view illustrating the flow of air through the filter and motor/fan assembly to an exhaust port in the lid of FIG. 11.

Referring now to FIG. 15, when lid 124 is raised to its vertical position, the plane of opening 222 is rotated 190 degrees with respect to the standard void which exists between the lower surface of toilet seat 122 and the upper surface of bowl 120. In this position, air may be effectively and efficiently drawn from the interior of bowl 120 through opening 222 and into the filter compartment of the lid as is indicated by arrows 224. To further enhance the efficiency of air flow from the interior of the bowl through opening 222 in lid 124, runners 226 may be secured (e.g., by screws 228) to the under portion of seat 222 on both sides of opening 222. These runners extend downward towards the upper surface of bowl 120 and act as sidewalls to a channel leading to opening 222.

Figure 16:
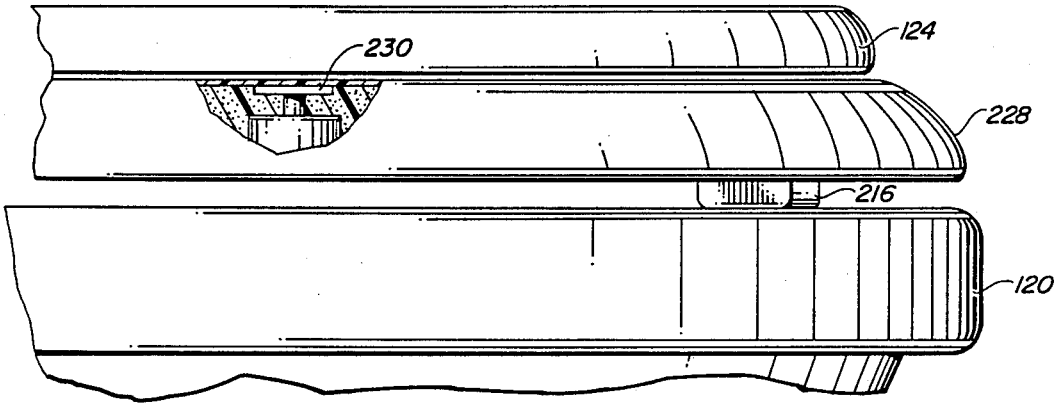
FIG. 16 illustrates an alternate switching arrangement for use in conjunction with a padded toilet seat in order to determine when a user is sitting on the seat.

FIG. 16 illustrates an alternate embodiment of detecting when a user is sitting on a padded seat 228. That is, a microswitch or pressure switch 230 may be housed within the padded portion of the seat, which switch closes as a result of the pressure exerted by a user sitting on the padded seat.

Figure 12:
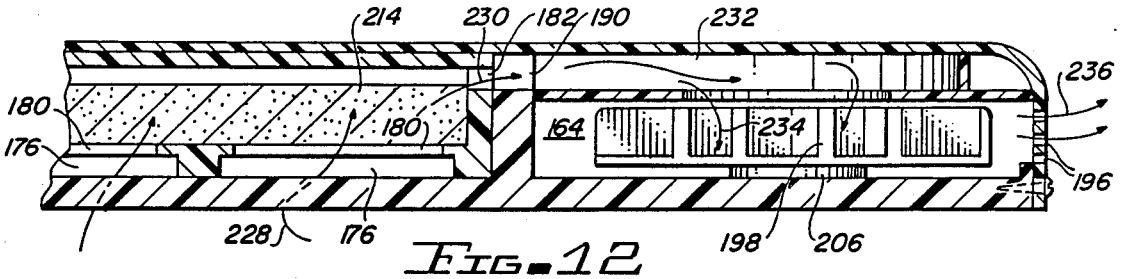
FIG. 12 is a cross-sectional view of the lid shown in FIG. 11 taken along line 12—12.

FIGS. 12 and 15 illustrate in greater detail the air flow through the inventive deodorizing lid. Malodorous air flows from the toilet bowl through opening 222 in the lid and then through recess portions 176 at the under portion of sidewall 192 of the filter. The air then flows through windows 180 in the under portion of the filter housing and into the filter medium as is indicated by arrows 228. Filtered air exits opening 182 in the filter housing and passes through openings 190 in a sidewall of the filter compartment as is indicated by arrows 230 into a region 232 above fan 198. The rotary motion of fan 198 imparted by direct drive motor 206 causes the filtered air to be drawn downward as indicated by arrow 234 and then laterally outward through apertures 196 as indicated by arrows 236. For efficiency of operation, fan 198 rotates in a direction such that the vanes are swept rearwardly, i.e. the outer end of each vane is spaced rearwardly of the inner end with respect to the direction of rotation.

FIG. 20 is a schematic diagram illustrating how motor 206 is energized so as to drive fan 198. As can be seen, a source of power (e.g., DC batteries of AC-DC adapter) is placed in series with tilt switch 160, pressure switch 218 and the terminals of motor 206. Thus, if tilt switch 160 is closed indicating that lid 124 is in its vertical position, and pressure switch 218 is closed indicating that a user is resting on seat 122, energy from DC source 238 will be supplied to motor 206. If desired, a simple delay circuit 240 may be placed across the terminals of motor 206 which permits motor 206 to continue operation for a predetermined period of time after the user removes himself from seat 122. This will permit a period of continued deodorizing after use of the toilet has ceased.

Figure 21:
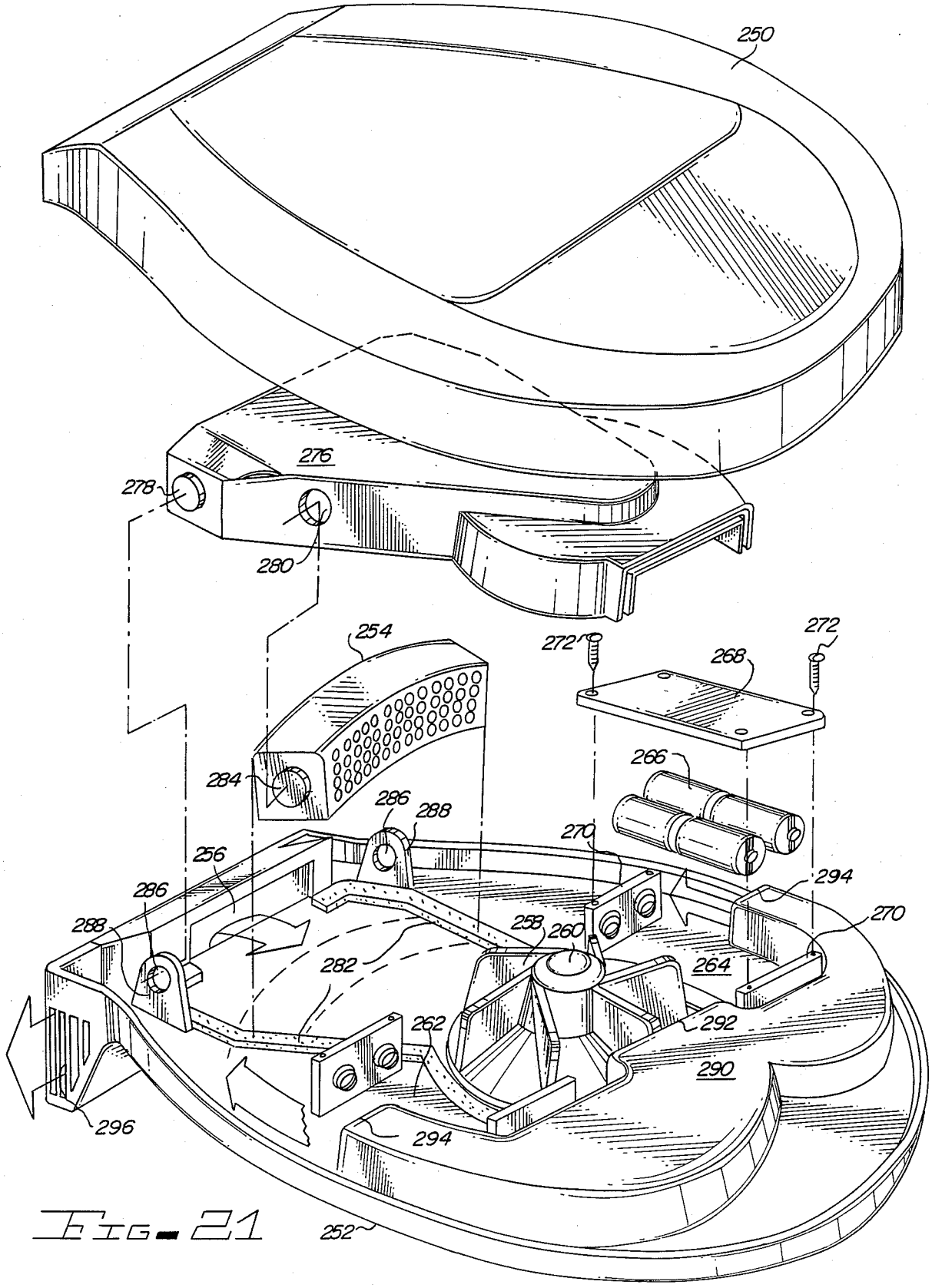
FIG. 21 is an exploded view of an alternate inventive in-lid deodorizing system.

FIGS. 21–30 illustrate an alternate embodiment of the inventive in-lid deodorizing system. Referring specifically to FIG. 21, and the hollow lid of this embodiment includes a cover 250 which is matingly received by a base 252. A charcoal filter 254 is provided through which malodorous air is drawn from opening 256 by fan 258. Again, fan 258 may be driven by a centrally mounted direct drive motor 260.

First and second battery compartments and 264 are provided for housing batteries such as is shown at 266. A cover plate 268 is secured to walls 270 as for example by screws 272 in order to maintain the batteries in their proper position. A switch 274 (FIG. 22) is provided for activating one or the other battery pack.

A cover 276 equipped with a projection 278 has an aperture 280 on each side thereof (only one side shown for convenience) cooperates with seals 282 to form a chamber which houses filter 254 and fan 258. Filter 254 is equipped with a projection 284 at each end thereof which are matingly received by apertures 280 in cover 276 to secure the filter. In a similar fashion, projections 278 and cover 276 are matingly received in apertures 286 in post 288 to secure cover 276 in postion.

A hollow channel assembly 290 forms, in conjunction with base 252, an air tunnel which receives filtered air at its inlet 292 adjacent fan 258 and directs the filtered air to outlets 294. From there, the filtered air proceeds to air outlet orifices 296 on each side of the rear portion of the lid (only one side shown for convenience).

The air flow is better explained in conjunction with FIG. 22. Malodorous air from the toilet enters via opening 256 as indicated by arrows 298. The air passes through filter 254 as indicated by arrows 300 due to the action of fan 258, and the filtered air is directed into tunnel 290 as indicated by arrows 302. The filtered air then exits outlets 294 of tunnel 290 and flows to outlet orifices 296 as indicated by arrows 304.

Placing air exhaust orifices 296 on each side of the lid has several advantages. First, a decorative cover may be used on the lid without interfering with the air flow. Second, air flow in this location is less likely to be interfered with by the clothing of the user. It is also significant to note that a straight through air flow from opening 256 through charcoal filter 254 permits the filter to be used in a uniform manner. There are no dead air spots. An additional advantage resides in the fact that the extra space provided around the impeller or fan within cover 276 permits quiet operation of the unit.

Figure 29:
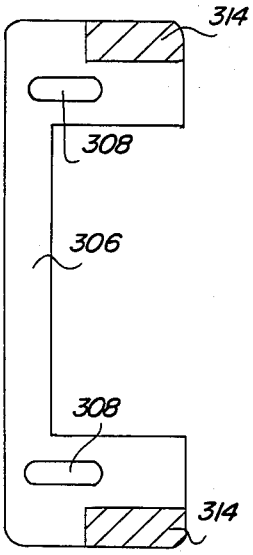
FIG. 29 is a cross-sectional view of the in-lid deodorizing system of FIG. 23 taken along line 29—29.
Figure 27:
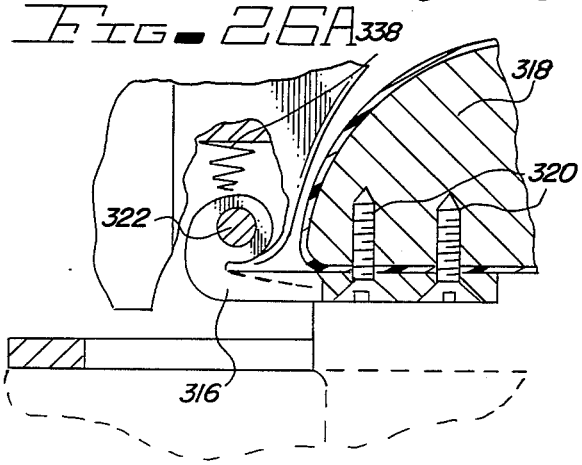
FIGS. 27 and 27A are side cross-sectional views of the in-lid deodorizing system of FIG. 23 taken along line 27—27 illustrating an innovative switching system.

FIGS. 23 and 29 illustrate in part the apparatus employed to hingedly secure the in-lid deodorizing system to a toilet bowl. A hinge post plate 306 having apertures 308 therein is secured to the toilet bowl 310 by means of bolts 312 in the well known manner. Plate 306 comprises upstanding hinge posts 314 positioned at each end thereof. Additional C-shaped hinge posts 316 (see also FIGS. 27 and 27A) are fixedly secure to seat 318 as for example by screws 320 as is shown in FIG. 27. A hinge pin 322 passes through aligned apertures and hinge posts 314 and 316 such that both the lid and the toilet seat are independently rotatable thereabout.

Hinge pin 322 shown in more detail in FIGS. 24 and 25 results in a stiff but smooth action of the hinge and prevents the seat and lid from slamming down hard. Hinge pin 322 comprises a bolt 324 having a head 326 and a shank 328. Shank 328 passes through a plastic (e.g. teflon) sleeve 330 having a diameter so as to be frictionally received within the apertures of hinge posts 314 and 316. Washers 332 are placed at opposite ends of sleeves 330 and the entire assembly is secured by nut 334.

Figure 27A:
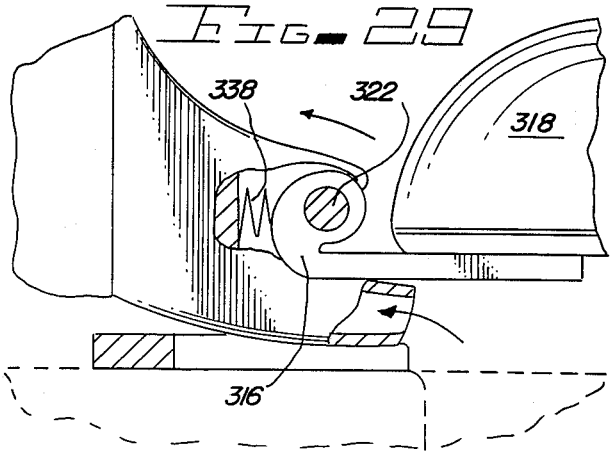

Positioned within spaces 336 above hinge posts 316 (see FIGS. 23, 27 and 27A) are electrical contacts (e.g. springs) 338. Hinge posts 316 are made of an electrically conductive material and are cam shaped such that when the lid is in its horizontal position, contact 338 does not engage hinge post 316 as is shown in FIG. 27. However, when the lid is raised to its vertical position such as is shown in FIG. 27A, contact 338 engages hinge post 316. Assuming that a pressure switch is placed in the seat as discussed in connection with the previous embodiments, motor 260 will be energized when the lid is in its vertical position and a user is sitting on seat 318. A circuit for accomplishing this function is shown in FIG. 30. As is shown, a motor 340 is placed in series with a switch 342 corresponding to contacts switches 336 and hinge post 316. Switch 344 corresponds to a pressure switch in the seat and switch 346 corresponds to switch 274 in FIG. 22 for switching between the first and second power packs 348 and 350. Thus, it can be seen that for the circuit to be complete, the lid must be in its vertical position and the user must be sitting on the seat.

Figure 26:
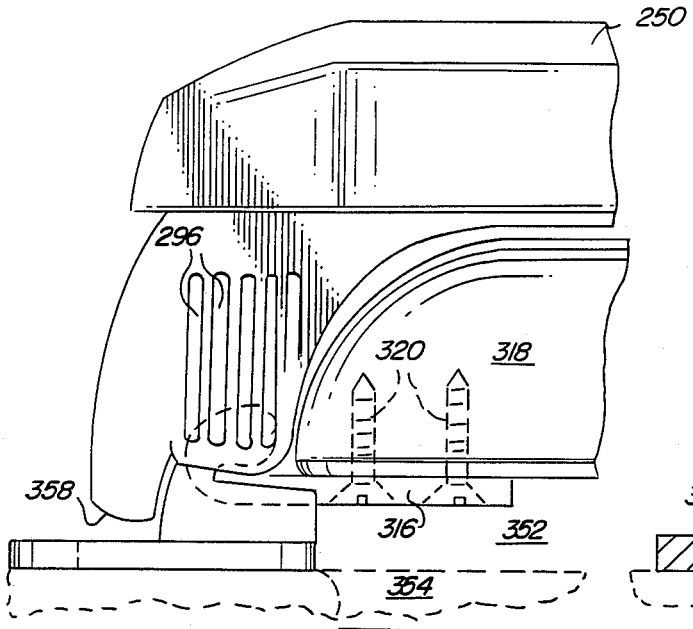
FIGS. 26 and 26A are side views of the in-lid deodorizing system of FIGS. 23 taken along line 26—26 illustrating the lid in its lowered and raised positions respectively.
Figure 28:
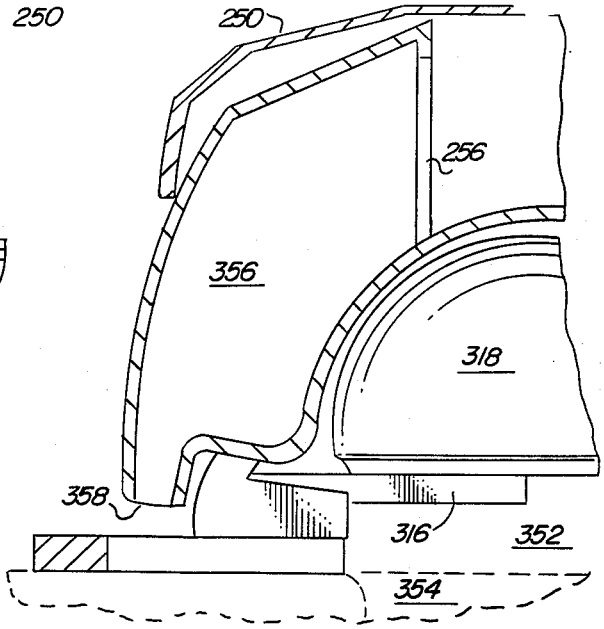
FIG. 28 is a side cross-sectional view of the rear portion of the in-lid deodorizing system of FIG. 23 taken along line 28—28.
Figure 26A:
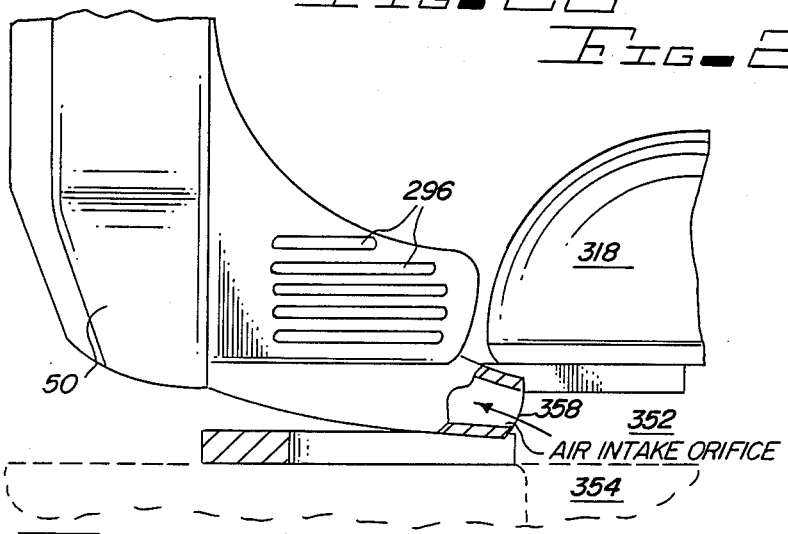

Referring to FIGS. 26, 26A and 28, a void 352 exists between the seat in its horizontal position and the top of the toilet bowl 354 as was the case in the previous embodiment. The rear portion of the lid forms a conduit 356 having an air intake 358 and a air exit corresponding to opening 256. In FIG. 26, lid 250 is in its horizontal position and inlet 358 is positioned behind void 352. However when the lid is raised, inlet 358 rotates into juxtaposition with void 352 as is shown in FIG. 26A. In this position, malodorous air from the interior of the toilet bowl can be efficiently drawn into inlet 358 and is processed in the in-lid deodorizing system.

It should be apparent that while two hinge switches have been shown, it is only necessary to provide one in order to complete the circuit when the lid is placed in its vertical position.

Thus, there has been disclosed an improved toilet lid air deodorizing system. The deodorizing system is activated only when the lid is placed in a vertical position and a user is resting on the toilet seat. The deodorizing systems air passage is coupled to the bowl area only when the lid is in its vertical position. The entrance to the airway is located for optimum efficiency.

The above description is given by way of example only. Changes in form and details may be made by one skilled in the art without departing from the scope of the invention as defined by the appended claims:

I claim:

1. In a water closet air ventilating system including a seat spaced above the upper surface of a toilet bowl and defining an air space therebetween, a lid for selectively covering said seat, hinge means having an axis of rotation for coupling said lid to said bowl for movement between a substantially horizontal closed position and an upright open position, and air flow means including an air pathway carried by said lid, improvements therein for efficient entrance of air into said air flow means when said lid is in the open position, said improvements comprising:

a. an inlet conduit depending from said lid and communicating with said air pathway; and b. said inlet conduit terminating in a spout defining an air inlet opening for receiving air from said toilet bowl, said inlet opening residing remotely from said air space between the upper surface of said bowl and said seat when said lid is in the closed position, and said inlet opening residing below said seat and within said air space between said seat and the upper surface of said bowl when said lid is in the open position.

2. The improvements of claim 1, wherein said inlet conduit is rigidly affixed to said lid and said inlet opening rotates about the axis of rotation of said hinge means as said lid is moved between the closed position and the open position.

3. The improvements of claim 2, wherein said inlet opening resides in a substantially horizontal plane when said lid is in the closed position and resides in an upright plane when said lid is in the open position.

4. The improvements of claim 1, wherein said inlet conduit extends from said lid and thence downwardly to reside in close proximity to said seat when said lid is in the closed position and at least partially within the space between said seat and the upper surface of said bowl when said lid is in the open position.

5. The improvements of claim 1, further including an air outlet conduit carried by said lid and residing laterally of said inlet conduit.

6. The improvements of claim 5, wherein said outlet conduit includes an outlet opening residing rearwardly of said seat and positioned for discharging air in a direction laterally from said toilet bowl.

7. The improvements of claim 6, wherein said hinge means includes a hinge post upstanding from said bowl and residing intermediate said air inlet opening and said air outlet opening.

8. A water closet air ventilating system including:

a seat spaced above the upper surface of a toilet bowl and defining an air space therebetween, a lid for selectively covering said seat, hinge means including a hinge post upstanding from said bowl, said hinge means having an axis of rotation located above said bowl for coupling said lid to said bowl for movement between a substantially horizontal closed position and an upright open position, air flow means including an air pathway carried by said lid, and an inlet conduit depending from said lid, said inlet conduit communicating at one end with said air pathway and terminating in a spout defining an air inlet opening at the opposite end thereof, said inlet conduit below said seat and below the axis of rotation of said hinge means, said inlet conduit being rotatable with said lid from a first position, in which said lid is closed and said inlet opening resides remotely from said air space between the upper surface of the bowl so that said air inlet opening receives air primarily from outside said toilet bowl, to a second position, in which said lid is open and said inlet opening extends in said air space between the seat and the upper surface of the bowl so that said air inlet opening resides within said space and receives air primarily from inside said toilet bowl.

9. The water closet air ventilating system of claim 8, further including an air outlet conduit carried by said lid and residing laterally of said inlet conduit.

10. The water closet air ventilating system of claim 9, wherein said outlet conduit includes an outlet opening residing rearwardly of said seat and positioned for discharging air in a direction laterally from said toilet bowl.

11. The water closet air ventilating system of claim 10, in which said outlet opening is located beneath said seat.

* * * * *